US006674456B2

(12) United States Patent
Miyazaki

(10) Patent No.: US 6,674,456 B2
(45) Date of Patent: Jan. 6, 2004

(54) PRINTER AND PRINTING METHOD CAPABLE OF DOUBLE-SIDED PRINTING

(75) Inventor: Takao Miyazaki, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/201,889

(22) Filed: Jul. 25, 2002

(65) Prior Publication Data

US 2003/0025779 A1 Feb. 6, 2003

(30) Foreign Application Priority Data

Jul. 31, 2001 (JP) ..... 2001-230991

(51) Int. Cl.[7] ..... B41J 3/60; B41J 2/32
(52) U.S. Cl. ..... 347/171; 399/364; 355/26
(58) Field of Search ..... 347/171; 399/364, 399/401; 355/26, 24

(56) References Cited

U.S. PATENT DOCUMENTS 6,333,774 B1 12/2001 Ito et al.

FOREIGN PATENT DOCUMENTS

JP 5-11529 1/1993
JP 2000-94783 4/2000
JP 2000-289259 A * 10/2000 ..... B41J/3/60

* cited by examiner

*Primary Examiner*—Huan H. Tran
(74) *Attorney, Agent, or Firm*—Sughrue Mion, PLLC

(57) ABSTRACT

A thermal printer includes a thermal printing head in an image forming section, which prints an image on one of first and second surfaces of a recording sheet oriented downwards. Feeder rollers feed the recording sheet to the image forming section after the recording sheet is set in a sheet supply slot. The printer includes at least one first memory for storing first image data of an image for being printed on the first surface, and second image data of an image for being printed on the second surface. The first or second image data are read from the first memory, and input to the image forming section. A second memory stores information of discrimination bar code adapted for designating the second image data associated with the first image data according to common assignment to the recording sheet. The information of the discrimination bar code is read from the second memory at a time of printing with the first image data to the first surface, and is printed on the first surface by the image forming section. A reading CCD reads the discrimination bar code from the first surface at a time of printing to the second surface. The second image data is specified according to the discrimination bar code, read from the first memory, and input to the image forming section.

10 Claims, 8 Drawing Sheets

PRINTER AND PRINTING METHOD CAPABLE OF DOUBLE-SIDED PRINTING

BACKGROUND OF THE INVENTION

1. Field of the Invention

The present invention relates to a printer and printing method capable of double-sided printing. More particularly, the present invention relates to a printer and printing method in which images are printed to two surfaces of a recording sheet after loading of the recording sheet for two times, and a combination of the images can be correct in a print without an error.

2. Description Related to the Prior Art

A general type of a printer is normally operated to print an image to one recording surface at one time, but can be used for double-sided printing in which a first image is printed to one front surface of a recording sheet, and then a second image is printed to its rear surface after turning over the recording sheet. For reliability in the operation of the double-sided printing, it is important to set an orientation of the recording sheet for a recording head direction of the printer at the time of printing to the rear surface, and also to check an image to be printed to the rear surface of the recording sheet in an exact combination with the image printed to the front surface.

JP-A 5-011529 discloses the printer of which a printer body is provided with an indicator panel, which indicates a placing orientation of the recording sheet at the time of printing to the rear surface, and information of a feeding order of the recording sheet. This prevents errors in double printing to the front surface, and prevents errors in the combination of an original images between the front and rear surfaces. JP-A 2000-094783 discloses the printer in which a discrimination indicia is printed at the time of printing to the front surface for the purpose of recording information of associating the original image of the front surface with the original image of the rear surface. Also, the printer records a direction indicia for recognizing a feeding direction of the recording sheet. At the time of printing to the rear surface, a reading sensor reads the direction indicia or the discrimination indicia, to estimate the feeding direction of the recording sheet. Only when the recording sheet has the discrimination indicia associated with the original image, an image is printed to the rear surface. This is to combine the original images without fail between the front and rear surfaces.

In the printer of JP-A 5-011529, the indicator panel only shows information that the front surface of the recording sheet should be oriented upwards or downwards after the front printing. As an instruction of the feeding direction is not indicated, an error is likely to occur in a printing direction between the front and rear surfaces according to an error in the feeding direction of the recording sheet. Also, if there is an error in the sequence of feeding of the recording sheets, inconsistency occurs in the original images between the front and rear surfaces. Also, the printer of JP-A 2000-094783 automatically ejects the recording sheet if the feeding direction of the recording sheet is wrong at the time of printing to the rear surface, or if the recording sheet being supplied is unsuitable for the original image of the rear surface. Problems arise in that waste time is considerably long and that processing cannot be quick specifically when the feeding direction of a stack of the recording sheets in a great number is wrong, or when a sequence of supply of the recording sheets is wrong.

SUMMARY OF THE INVENTION

In view of the foregoing problems, an object of the present invention is to provide a printer in which images are printed to two surfaces of a recording sheet, and a combination of the images can be correctly determined with great ease in relation to orientation and direction of the front and rear surfaces without an error.

In order to achieve the above and other objects and advantages of this invention, a printer includes an image forming section for printing an image on one of first and second surfaces of a recording sheet oriented in a recordable orientation. A feeder feeds the recording sheet to the image forming section after the recording sheet is set in a sheet supply section. The printer includes at least one first memory for storing first image data of an image for being printed on the first surface, and second image data of an image for being printed on the second surface, the first or second image data being read from the first memory, and input to the image forming section. A second memory stores discrimination information adapted for designating the second image data associated with the first image data according to common assignment to the recording sheet, wherein the discrimination information is read from the second memory at a time of printing with the first image data to the first surface, and is printed on the first surface by the image forming section. A first reader reads the discrimination information from the first surface at a time of printing to the second surface, the second image data being specified according to the discrimination information, read from the first memory, and input to the image forming section.

The image forming section prints a positioning pointer on the first surface at the printing time to the first surface, the positioning pointer being adapted for positioning the recording sheet when the recording sheet is set in the sheet supply section for printing to the second surface.

Furthermore, a second reader reads sheet type information prerecorded on the second surface, the first image data being specified according to the sheet type information, and subjected to printing on the first surface.

The discrimination information, the positioning pointer and the sheet type information are recorded on an advancing edge portion of the recording sheet.

The image forming section includes a thermal head for printing to the recording sheet being thermosensitive. A platen roller is disposed higher than the thermal head, for supporting the recording sheet.

The recordable orientation is a downward orientation.

The discrimination information is formed in an edge portion of the recording sheet, and has a patterned shape determined by encoding two-surface combining information.

Furthermore, a sheet supply slot receives the recording sheet set therein, to supply the recording sheet to the image forming section. A target pointer is disposed at the sheet supply slot, and so positioned that the positioning pointer becomes opposed thereto when the recording sheet is turned over and reloaded.

The sheet type information is formed in an edge portion of the second surface, and has a patterned shape determined by encoding a type of the recording sheet, and the second reader is constituted by the first reader.

According to another aspect of the invention, a printing method of printing an image on a first surface of a recording sheet, and serially an image on a second surface of the recording sheet, is provided. At first, the recording sheet is set in a sheet supply section in orienting the first surface in a recordable orientation. The recording sheet is fed to an image forming section. An image is printed on the first surface with the image forming section according to first image data, then the recording sheet being exited to a sheet exit section. In the printing step to the first surface, a positioning pointer is printed on the first surface for designating a position of the recording sheet. After the printing step to the first surface, the recording sheet is set in the sheet supply section in setting the positioning pointer at a target pointer of the sheet supply section, the second surface being oriented in the recordable orientation. The recording sheet is fed to the image forming section. An image is printed on the second surface with the image forming section according to the second image data, then the recording sheet being exited to the sheet exit section.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
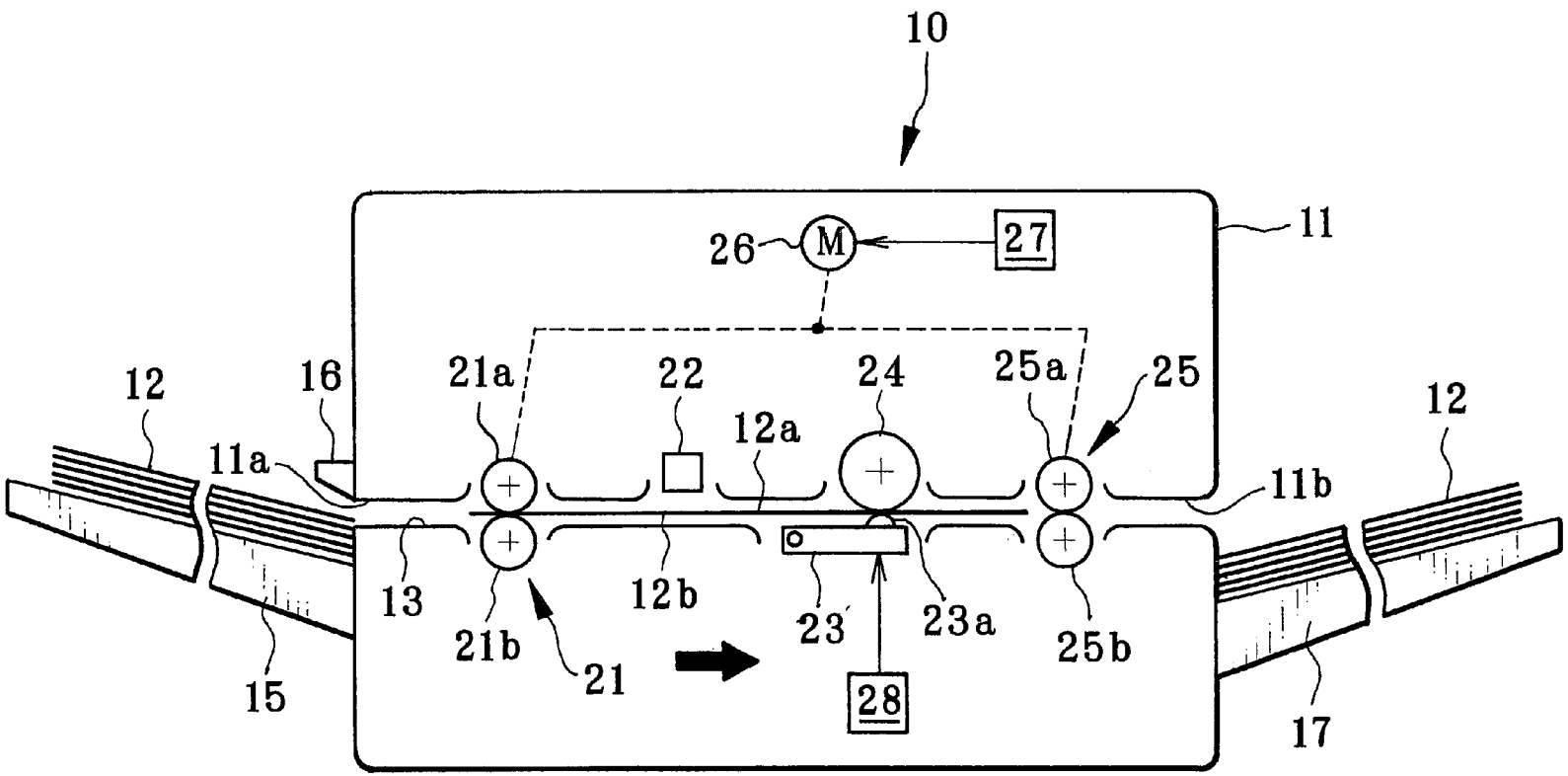
FIG. 1 is an explanatory view in elevation, illustrating a thermal printer.
Figure 2:
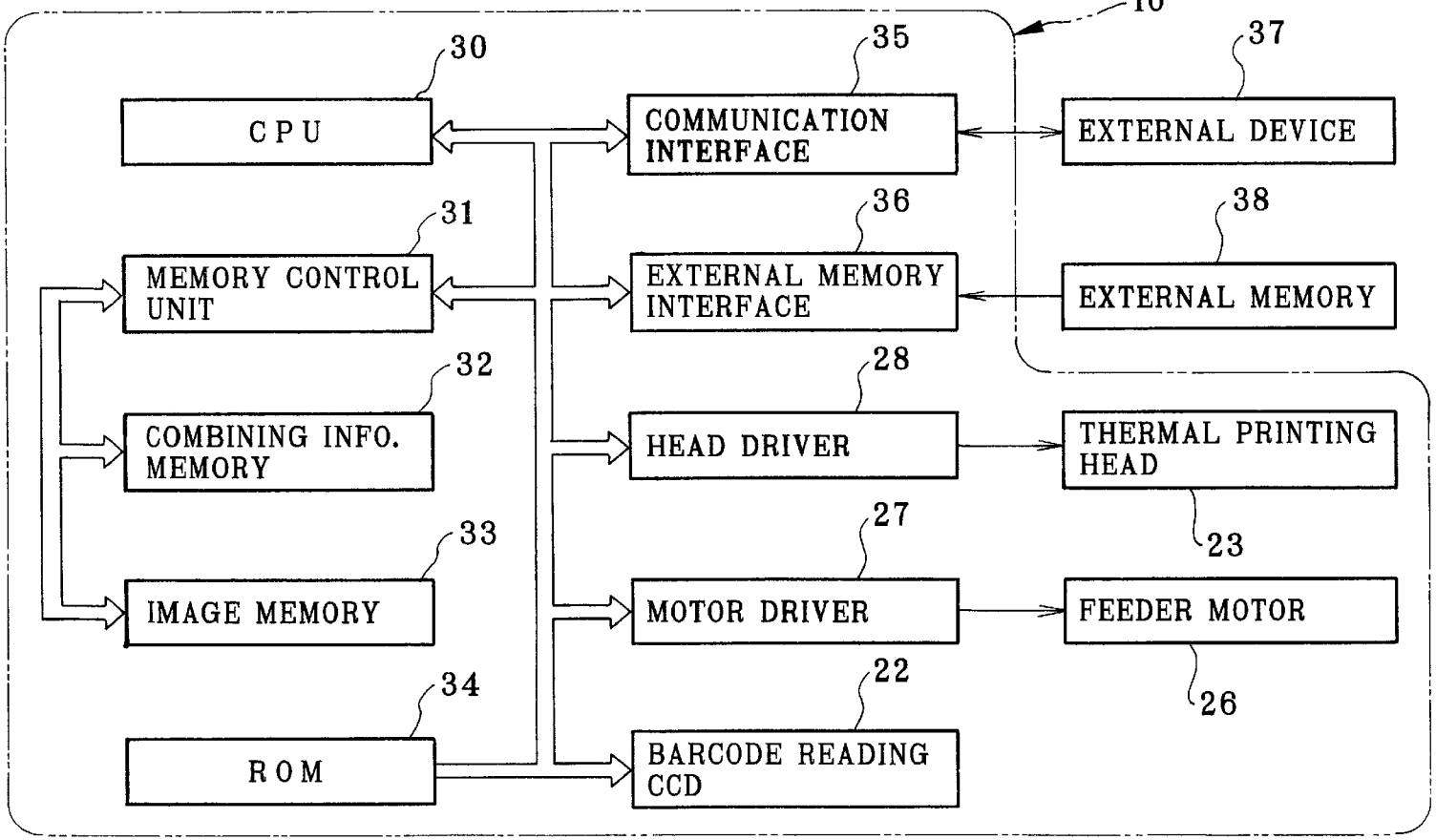
FIG. 2 is a block diagram illustrating the thermal printer.

In FIGS. 1 and 2, a thermal printer 10 as image forming device of the present invention is illustrated. A printer body 11 of the thermal printer 10 has a feeding path 13 through which thermosensitive recording sheets 12 are fed in the arrow direction in the drawing. There are a sheet supply slot 11*a* and a sheet exit slot 11*b* formed in the printer body 11. The sheet supply slot 11*a* receives insertion of the recording sheets 12 into the feeding path 13. The sheet exit slot 11*b* ejects the recording sheets 12 from the feeding path 13. A sheet supply tray 15 is disposed at the sheet supply slot 11*a* for supporting the recording sheets 12 to be inserted. A cover ridge 16 protrudes from an upper side of the sheet supply slot 11*a*. A positioning target pointer 16*a* is indicated on the cover ridge 16. See FIG. 4. A sheet exit tray 17 is disposed at the sheet exit slot 11*b* for supporting the recording sheets 12 after being exited.

In the feeding path 13 are disposed feeder rollers 21, a bar code reading CCD 22 as an information reader, a thermal printing head 23, a platen roller 24, and ejection rollers 25. The feeder rollers 21 include a capstan roller 21*a* and a pinch roller 21*b* disposed under the capstan roller 21*a*. The ejection rollers 25 include a capstan roller 25*a* and a pinch roller 25*b* disposed under the capstan roller 25*a*. When an advancing edge of the recording sheet 12 reaches a position of the feeder rollers 21 or the ejection rollers 25, the pinch roller 21*b* or 25*b* is shifted to nip the recording sheet 12. A feeder motor 26 is connected with the capstan rollers 21*a* and 25*a*. A motor driver 27 drives the feeder motor 26. A CPU 30 is connected with the motor driver 27, and causes the motor driver 27 to control rotation of the feeder motor 26. CPU 30 will be described later in detail.

Figure 3:
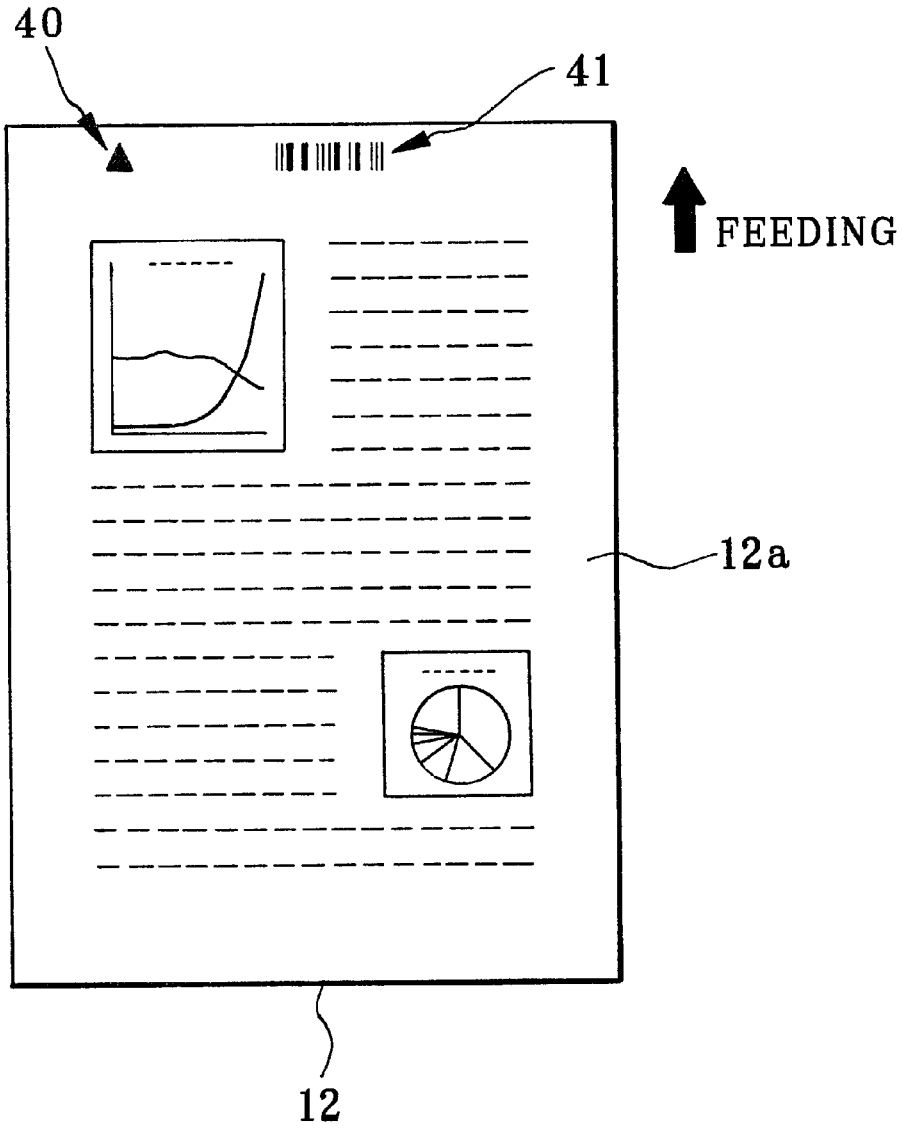
FIG. 3 is a plan illustrating a thermosensitive recording sheet after front printing.

The bar code reading CCD 22 is a reading sensor for reading a discrimination bar code depicted in FIG. 3. The bar code reading CCD 22 is secured to an upper wall of the feeding path 13, and is so positioned as to read the bar code in a first surface of the recording sheet 12 before the recording sheet 12 reaches position of printing at the thermal printing head 23 for printing to a second surface.

The thermal printing head 23 as image forming section is disposed under the feeding path 13. A heating element array 23*a* in the thermal printing head 23 includes a great number of heating elements arranged on one line in a main scan direction that is a width direction of the recording sheet 12. A head driver 28 is connected with CPU 30, and caused by the same to drive the thermal printing head 23. The heating elements in the heating element array 23*a* are driven to develop heat at an intended temperature according to image data in synchronism with feeding of the recording sheet 12, and develops color in the recording sheet 12 by supplying heat energy.

The platen roller 24 is opposed to the thermal printing head 23, and disposed in the upper wall of the feeding path 13. A shifter mechanism (not shown) is connected with the platen roller 24, and shifts the platen roller 24 between first and second positions. The platen roller 24, when in the first position, causes the thermal printing head 23 to pressurize the recording sheet 12 at a suitable pressure of contact, and when in the second position, come away from the recording sheet 12 and up from the feeding path 13. The platen roller 24 is caused to rotate by the feeding of the recording sheet 12 in the printing, and stabilizes the contact between the recording sheet 12 and the heating elements.

In addition to the motor driver 27 and the head driver 28, CPU 30 is also connected with a memory control unit 31, a ROM 34, a communication interface 35, and an external memory interface 36. ROM 34 stores a control program for printing. A combining information memory 32 and an image memory 33 for rear printing are connected with the memory control unit 31.

To input image data for printing to the recording sheet 12, an external device 37 such as a personal computer is connected with the communication interface 35. Also, an external memory 38, such as smart media or RAM card, may be connected with the external memory interface 36 for inputting the image data. The image data is constituted by front image data and rear image data for images to be printed into the front and rear surfaces. The memory control unit 31 writes two-surface combining information to the combining information memory 32 for association between the front and rear image data. The memory control unit 31 writes rear image data to the image memory 33 for printing to a second surface of the recording sheet 12.

In FIG. 3, a positioning pointer 40 and a discrimination bar code 41 are printed on a first surface 12*a* of the recording sheet 12. To this end, CPU 30 drives the thermal printing head 23 for printing those. The positioning pointer 40 and the discrimination bar code 41 are formed in an advancing edge portion of the recording sheet 12 as viewed in the feeding direction. After this, a first image or front image is printed to the first surface 12*a* by the control of CPU 30.

Figure 4:
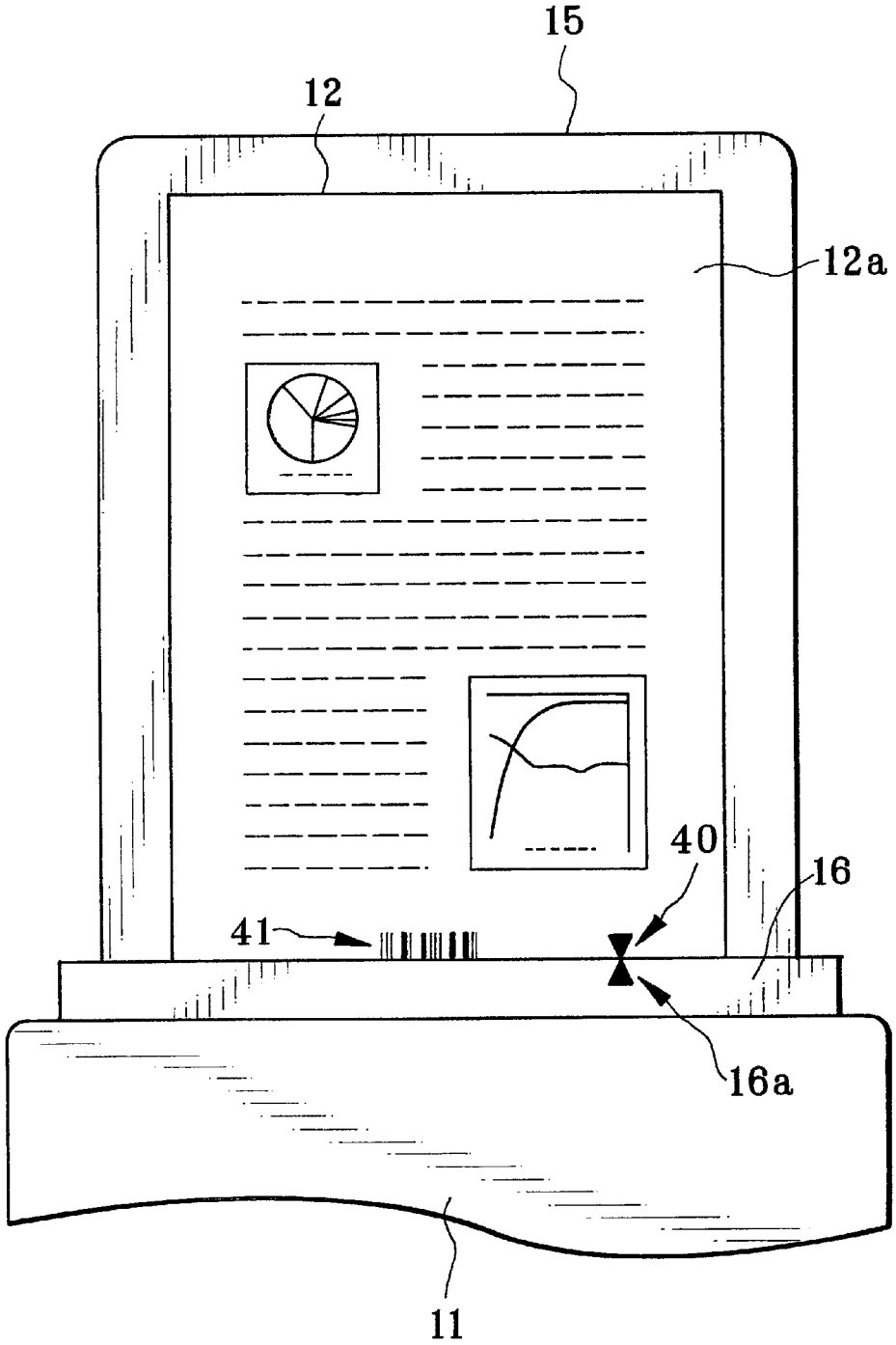
FIG. 4 is a plan, partially cutaway, illustrating the recording sheet and a sheet supply slot into which the recording sheet is being reinserted.

The positioning pointer 40 indicates an orientation in placement of the recording sheet 12 on the sheet supply tray 15 at the time of printing to a second surface 12*b*. The positioning pointer 40 also indicates a feeding direction in printing to a first surface 12*a* and the second surface 12*b*. In FIG. 4, the recording sheet 12 is placed on the sheet supply tray 15 to oppose the positioning pointer 40 to the positioning target pointer 16*a* of the cover ridge 16. The placing orientation and reinserting direction can be determined without failure. This being so, there occurs no error in the direction of placing and feeding the recording sheet 12 at the time of printing to the second surface 12*b*.

Note that, although the positioning target pointer 16*a* is positioned in a path of the positioning pointer 40, the positioning target pointer 16*a* may be previously formed in another suitable position. Furthermore, the positioning target pointer 16*a* may have a shape other than a triangular shape, and can be constituted by a hole, notch, projection or the like formed with the cover ridge 16.

The discrimination bar code 41 is a bar code for representing two-surface combining information for determining rear image data corresponding to the front image data of the image printed in the first surface 12*a*. Before the second surface 12*b* of the recording sheet 12 is subjected to printing, CPU 30 specifies the rear image data for the second surface 12*b* according to the information stored in the combining information memory 32 in response to reading of the discrimination bar code 41 with the bar code reading CCD 22. Thus, it is possible to associate the front image data for the first surface 12*a* with the rear image data for the second surface 12*b* if there occur changes in the sequence of feeding sheets. Note that the discrimination bar code 41 may be a code in a form including at least one sign, letter, number or the like instead of the bar code.

Figure 5:
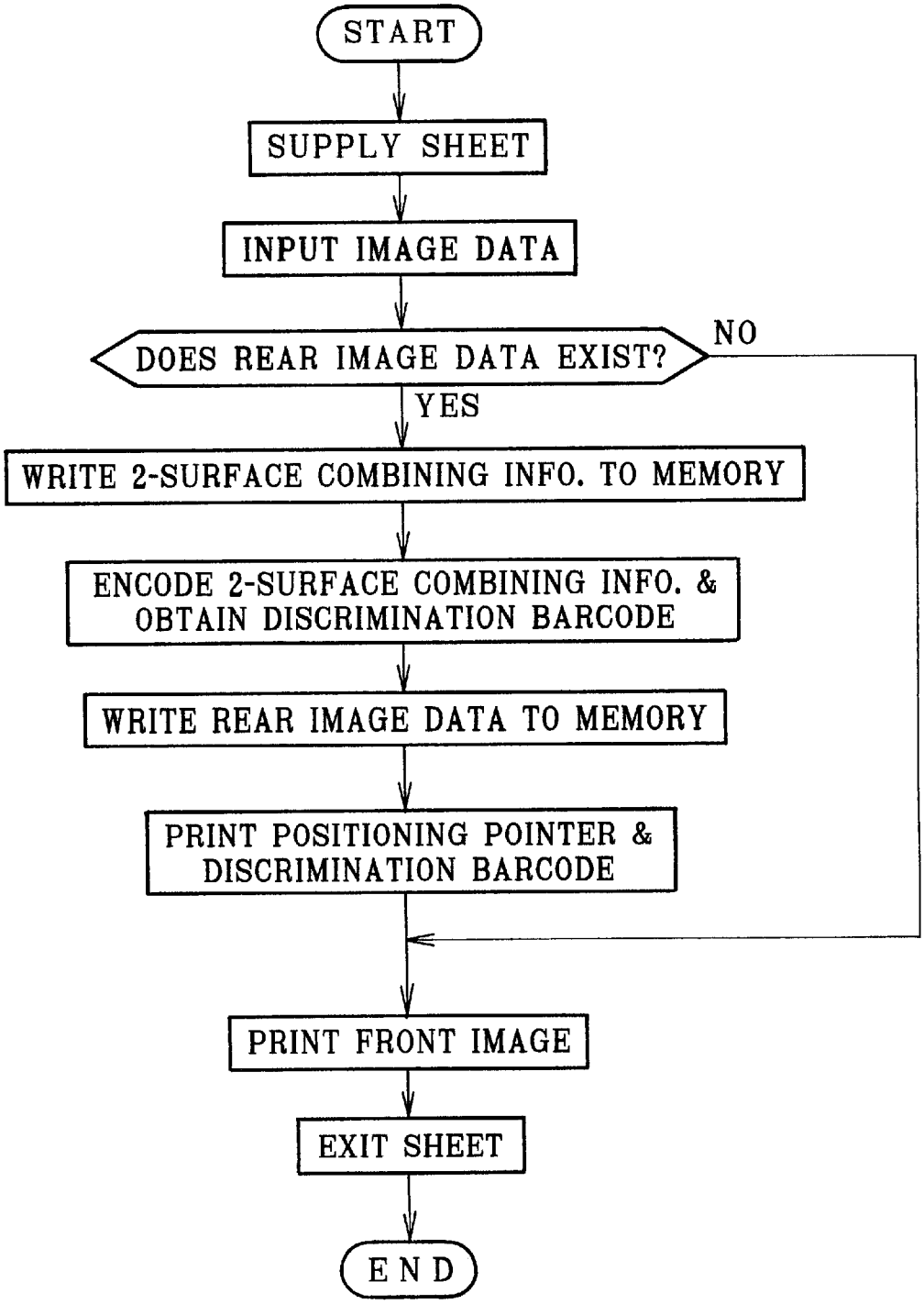
FIG. 5 is a flow chart illustrating a process of front printing.
Figure 6:
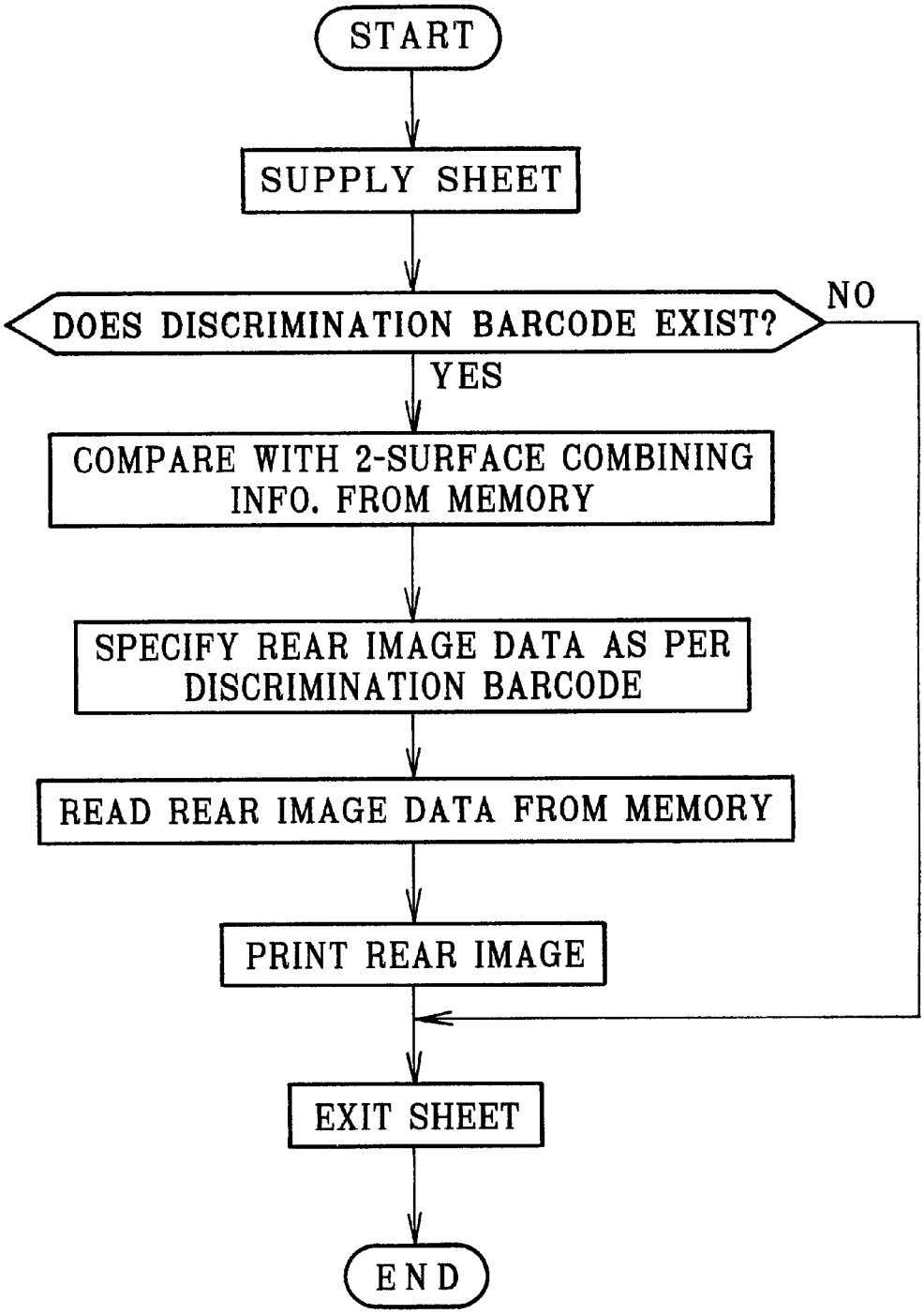
FIG. 6 is a flow chart illustrating a process of rear printing.

The operation of the above construction is described according to a flow in FIGS. 5 and 6. In FIG. 5, a command signal for start is input by operation of a button or key. Then one of the recording sheets 12 is fed from the sheet supply tray 15 to a printing position at the thermal printing head 23. Then image data, including front and rear image data, are input by the external device 37 or the external memory 38.

If no rear image data exists for the second surface 12*b* of the recording sheet 12, an image according to the front image data is printed to the first surface 12*a* of the recording sheet 12. If rear image data exists, then two-surface combining information is written to the combining information memory 32 for a relationship between the front and rear image data. Also, the rear image data is written to the image memory 33.

CPU 30 writes the two-surface combining information to the combining information memory 32, and creates data of the discrimination bar code 41 on the basis of the two-surface combining information. The positioning pointer 40 and the discrimination bar code 41 are printed to the advancing edge portion of the first surface 12*a* of the recording sheet 12, before an image of the front image data is printed. In FIG. 3, the printed state of the first surface 12*a* with the positioning pointer 40, the discrimination bar code 41 and the front image are depicted. After this, the recording sheet 12 is exited from the sheet exit slot 11*b*, and stacked in the sheet exit tray 17.

To print an image according to the rear image data to the second surface 12*b* of the recording sheet 12, the recording sheet 12 after the front printing is picked up from the sheet exit tray 17, turned over manually, and is placed on the sheet supply tray 15 again for reloading. In FIG. 4, the positioning pointer 40 is equally directed to the positioning target pointer 16*a* disposed on the cover ridge 16.

Then another command signal of starting is input. The recording sheet 12 is fed from the sheet supply tray 15 to the printing position at the thermal printing head 23. In the course of this feeding, the bar code reading CCD 22 reads the discrimination bar code 41 from the first surface 12*a* of the recording sheet 12.

If the discrimination bar code 41 does not exist, the recording sheet 12 is exited to the sheet exit tray 17. If the discrimination bar code 41 exists, then the two-surface combining information represented by the discrimination bar code 41 is compared with the two-surface combining information read from the combining information memory 32. Rear image data of an image to be printed to the second surface 12*b* is designated according to a result of the comparison. The rear image data associated with the front image data of an image printed on the first surface 12*a* is read from the image memory 33, to print a rear image to the second surface 12*b*. When printing of the second surface 12*b* is completed, the recording sheet 12 is exited through the sheet exit slot 11*b*, and received and stacked in the sheet exit tray 17.

Note that, although the bar code reading CCD 22 is a CCD or image area sensor, the bar code reading CCD 22 may be a bar code reader of any type.

Figure 7:
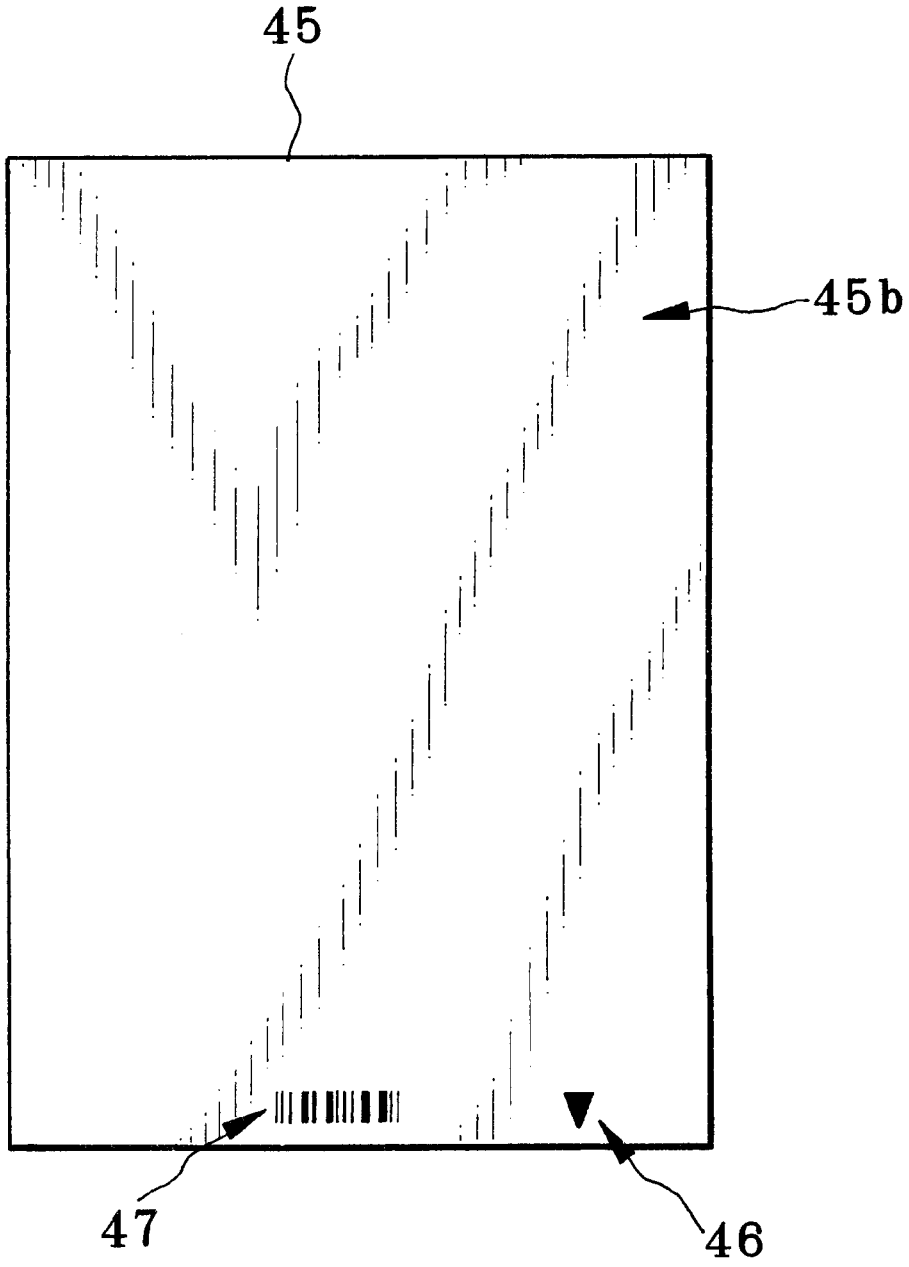
FIG. 7 is a plan illustrating another recording sheet with a preprinted bar code according to a preferred embodiment capable of protection of image data.

In the above embodiment, the discrimination bar code 41 is printed in the course of image printing. In FIG. 7, another preferred embodiment is illustrated, in which a thermosensitive recording sheet 45 is provided with a positioning pointer 46 and a sheet type bar code 47 preprinted in a second surface 45*b*. The sheet type bar code 47 is adapted for specifying the recording sheet 45 of a type allowed for printing with image data.

Note that, in place of the sheet type bar code 47, it is possible to form a patterned train of punch holes, notches or the like. It is also possible in place of the positioning pointer 46 to use a hole, notch or other open structure, or a projection of any suitable shape.

Figure 8:
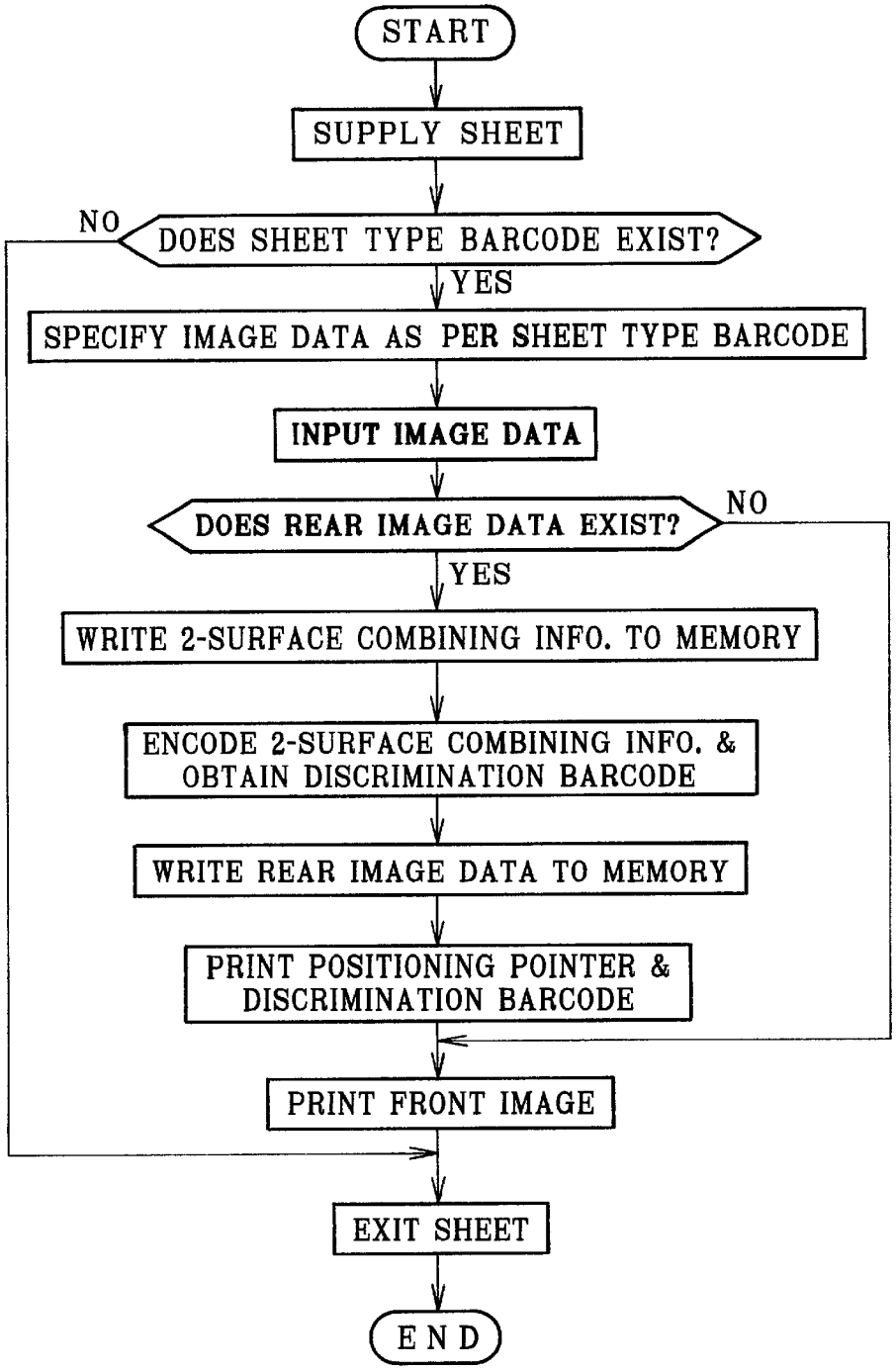
FIG. 8 is a flow chart illustrating a process of front printing for use with the recording sheet of FIG. 7.

In FIG. 8, a flow of printing according to another preferred embodiment is depicted. At first, the recording sheet 45 is placed in the sheet supply tray 15 to oppose the positioning pointer 46 to the positioning target pointer 16*a* of the cover ridge 16 in a manner similar to the rear printing according to the above embodiment. A start command signal is input. Then the recording sheet 45 is fed from the sheet supply tray 15 to a printing position at the thermal printing head 23. The bar code reading CCD 22 reads the sheet type bar code 47 from the second surface 45*b* of the recording sheet 45 in the course of feeding.

If the sheet type bar code 47 is not detected, the recording sheet 45 is exited to the sheet exit tray 17 without image printing to the recording sheet 45. If the sheet type bar code 47 is detected, then CPU 30 evaluates the sheet type bar code 47, and specifies image data of an image to be printed to the recording sheet 45. Front and rear image data are input by the external device 37 or the external memory 38. In a manner similar to the above-described embodiment, an image of the front image data is printed to a first surface of the recording sheet 45. A process after the process of FIG. 8 is as depicted in FIG. 6. An image of the rear image data is printed to the second surface 45*b* of the recording sheet 45. In conclusion, the images can be printed only to the recording sheet 45 having the sheet type bar code 47. This is effective in protecting secrecy of the image data of a user, because recording sheets without the sheet type bar code 47 are prevented from being used by outsiders for reproducing front and rear image data.

It is to be noted that, in the above embodiments, the discrimination bar code 41 and the sheet type bar code 47 are close to the advancing edge of the recording sheet. However, the discrimination bar code 41 and the sheet type bar code 47 may be disposed close to one of two lateral edges of the recording sheet. However, it is desirable to dispose the discrimination bar code 41 and the sheet type bar code 47 at a somewhat short distance to the advancing edge in order to be read reliably by the bar code reading CCD before an image printing.

Note that any one of the discrimination bar code 41 and the sheet type bar code 47 may be constituted by at least one sign, letter, number or the like. The positioning target pointer 16*a*, and the positioning pointers 40 and 46 can have a shape which can be checked easily by observation of a user. The discrimination bar code 41 and the sheet type bar code 47 can have a shape which can be checked easily by optical detection, and may be a binary code patterned by dots arranged intermittently, or OCR or the like.

In the embodiment of FIGS. 7 and 8, the sheet type bar code 47 and the positioning pointer 46 are disposed on the second surface 45*b* in contrast with the positioning pointer 40 and the discrimination bar code 41 printed on the first surface 12*a*. The sheet type bar code 47 is located in a position directly reverse to the discrimination bar code 41, and is read by the bar code reading CCD 22 shortly before the front printing, the bar code reading CCD 22 being used for reading the discrimination bar code 41.

However, a specialized sensor may be used for reading the sheet type bar code 47 as an element independent from the bar code reading CCD 22. The sheet type bar code 47 may be disposed in a position on the second surface 45*b* different from the position according to the above embodiment.

Furthermore, the sheet type bar code 47 may be formed on the first surface 12*a*. A sensor specified for reading the sheet type bar code 47 can be used, and oriented in an upward direction that is opposite to the orientation of the bar code reading CCD 22. In the first surface 12*a*, the sheet type bar code 47 may be disposed close to, or distant from, the discrimination bar code 41.

In the above embodiments, the thermal printer is monochromatic. However, a printer of the invention may be a full-color printer. Furthermore, a printer of the invention may be an ink jet printer, thermal transfer printer, video printer, laser printer, electrophotographic copying machine, or any type of printers suitable for double-sided printing.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A printer including an image forming section for printing an image on one of first and second surfaces of a recording sheet oriented in a recordable orientation, and a feeder for feeding said recording sheet to said image forming section after said recording sheet is set in a sheet supply section, said printer comprising:

at least one first memory for storing first image data of an image for being printed on said first surface, and second image data of an image for being printed on said second surface, said first or second image data being read from said first memory, and input to said image forming section;

a second memory for storing discrimination information adapted for designating said second image data associated with said first image data according to common assignment to said recording sheet, wherein said discrimination information is read from said second memory at a time of printing with said first image data to said first surface, and is printed on said first surface by said image forming section;

a first reader for reading said discrimination information from said first surface at a time of printing to said second surface, said second image data being specified according to said discrimination information, read from said first memory, and input to said image forming section.

2. A printer as defined in claim 1, wherein said image forming section prints a positioning pointer on said first surface at said printing time to said first surface, said positioning pointer being adapted for positioning said recording sheet when said recording sheet is set in said sheet supply section for printing to said second surface.

3. A printer as defined in claim 2, further comprising a second reader for reading sheet type information prerecorded on said second surface, said first image data being specified according to said sheet type information, and subjected to printing on said first surface.

4. A printer as defined in claim 3, wherein said discrimination information, said positioning pointer and said sheet type information are recorded on an advancing edge portion of said recording sheet.

5. A printer as defined in claim 4, wherein said image forming section includes:

a thermal head for printing to said recording sheet being thermosensitive;

a platen roller, disposed higher than said thermal head, for supporting said recording sheet.

6. A printer as defined in claim 5, wherein said recordable orientation is a downward orientation.

7. A printing method of printing an image on a first surface of a recording sheet, and serially an image on a second surface of said recording sheet, comprising steps of:

setting said recording sheet in a sheet supply section in orienting said first surface in a recordable orientation;

feeding said recording sheet to an image forming section;

printing an image on said first surface with said image forming section according to first image data, then said recording sheet being exited to a sheet exit section;

in said printing step to said first surface, printing discrimination information on said first surface, said discrimination information being adapted for discrimination of second image data for printing on said recording sheet together with said first image data;

after said printing step to said first surface, setting said recording sheet in said sheet supply section, said second surface being oriented in said recordable orientation;

feeding said recording sheet to said image forming section;

reading said discrimination information from said first surface before printing to said second surface;

printing an image on said second surface with said image forming section according to said second image data specified according to said discrimination information, then said recording sheet being exited to said sheet exit section.

8. A printing method as defined in claim 7, further comprising a step of, in said printing step to said first surface, printing a positioning pointer on said first surface, said positioning pointer designating a position of said recording sheet being set at a target pointer of said sheet supply section when said recording sheet is set in said sheet supply section for printing to said second surface.

9. A printing method of printing an image on a first surface of a recording sheet, and serially an image on a second surface of said recording sheet, comprising steps of:

setting said recording sheet in a sheet supply section in orienting said first surface in a recordable orientation;

feeding said recording sheet to an image forming section;

printing an image on said first surface with said image forming section according to first image data, then said recording sheet being exited to a sheet exit section;

in said printing step to said first surface, printing a positioning pointer on said first surface for designating a position of said recording sheet;

after said printing step to said first surface, setting said recording sheet in said sheet supply section in setting said positioning pointer at a target pointer of said sheet supply section, said second surface being oriented in said recordable orientation;

feeding said recording sheet to said image forming section;

printing an image on said second surface with said image forming section according to said second image data, then said recording sheet being exited to said sheet exit section.

10. The printer according to claim 2, further comprising a target pointer formed on said printer, such that said target pointer and said positioning pointer are opposed to each other when said recording sheet is set in said sheet supply section.

* * * * *